US005927548A

United States Patent [19]

Villaveces

[11] Patent Number: 5,927,548

[45] **Date of Patent: *Jul. 27, 1999**

[54] BODY-WORN DISPENSER FOR DISINFECTING GEL

[76] Inventor: James Villaveces, 88 Eugenia Dr., Ventura, Calif. 93003

[ * ] Notice: This patent is subject to a terminal disclaimer.

[21] Appl. No.: 08/874,525

[22] Filed: Jun. 13, 1997

Related U.S. Application Data

[63] Continuation-in-part of application No. 08/460,628, May 12, 1995, Pat. No. 5,683,012.

[51] Int. Cl.[6] ..... B67D 5/00

[52] U.S. Cl. ..... 222/82; 222/175; 222/321.7; 222/325; 222/209

[58] Field of Search ..... 222/82, 83, 175, 222/162, 182, 183, 321.1, 321.6–321.8, 325, 341, 382, 383.1, 378, 402.13, 383.3, 185.1, 209; 239/154, 329, 330

[56] References Cited

U.S. PATENT DOCUMENTS 5,215,227 6/1993 Farner ..... 222/321.6
5,429,301 7/1995 Franks ..... 222/175
5,509,578 4/1996 Livingstone ..... 222/321.6
5,683,012 11/1997 Villaveces ..... 222/82

*Primary Examiner*—Philippe Derakshani
*Attorney, Agent, or Firm*—Kenneth J. Hovet

[57] ABSTRACT

A dispenser for dispensing an alcohol-glycerine disinfecting gel or liquid for use by doctors and nurses. The dispenser consists of a main housing which mounts a pumping mechanism for pumping out an alcohol-glycerine disinfecting gel from a replaceable, disposable supply-cartridge releasably mounted in the main housing. Since the main housing is small enough to fit within a person's hand, the doctor or nurse may dispense the contents of an alcohol-glycerine disinfecting gel simply by squeezing the two parts together. The dispensing of the gel is applied directly onto the fingers of the same hand that has squeezed the main housing to have caused such dispensing to occur. Owing to the small size of the main housing, the dispenser of the invention may be worn on-the-person, such as by the waist-belt.

19 Claims, 6 Drawing Sheets

BODY-WORN DISPENSER FOR DISINFECTING GEL

CROSS-REFERENCE TO RELATED APPLICATION

This is a continuation-in-part of application Ser. No. 08/460,628, filed on May 12, 1995 now U.S. Pat. No. 5,683,012 dated Nov. 4, 1997.

BACKGROUND OF THE INVENTION

The present invention is directed to a dispenser for dispensing a small amount of alcohol gel hand rub for use by physicians and nurses during their normal activities, which dispenser is carried on the person.

It has been well established that one of the most efficacious antimicrobial hand gel is one that contains alcohol. It has also been established that a potentially major source of infection, such as gram-negative nosocomial pathogens, may be transmitted via the hands of a physician or nurse, after he or she has examined a patient, and has not disinfected the hands. Because of the busy schedule that physicians and nurses experience, it is not usually practicable or possible to disinfect the hands after having examined a patient. Simple washing of the hands with soap and water will not effectively disinfect that hands, and, moreover, repeated and frequent washing of the hands will cause them to become chafed and chapped, which will discourage the doctor or nurse from washing the next time such should be performed. Thus, the hands may go unwashed altogether.

In order to better disinfect the hands, doctors and nurses use a disinfecting liquid, such as "Ultracol" manufactured by Dexide, Inc. of Fort Worth, Tex., which contains ethyl alcohol and chloroxylenol in a glycerine gel base. The alcohol acts as a very effective disinfectant, while the glycerine base prevents chafing and chapping of the hands from the alcohol. However, the relatively-large containers storing these alcohol-glycerine gels are usually stored at a central location that is distant from the patients' rooms in a hospital, and the like. Since it is not feasible to return to such a central location after having examined every patient, nor of carrying such large containers around, the doctor or nurse will just simply wash the hands with soap and water, or not wash them at all, if they have become chafed and chapped from repeated and frequent soap-and-water washings, thus exposing patients to possible infection during the examination by the physician or nurse.

SUMMARY OF THE INVENTION

It is the primary objective of the present invention to provide a small dispenser for an alcohol-glycerine disinfecting gel that may be worn on-the-person, such as being attached to the belt.

It is another objective of the invention to provide such a dispenser that is small enough so that its contents may be dispensed by using just one hand.

It is yet another objective of the invention to provide a small dispenser of an alcohol-glycerine disinfecting gel which utilizes replaceable supply-cartridges, with each supply-cartridge filled with an alcohol-glycerine disinfecting gel, which supply-cartridge is easily inserted into the dispenser when full, and easily removed therefrom when empty for replacement with a new, full cartridge.

Toward these and other ends, the dispenser of the invention for dispensing an alcohol-glycerine disinfecting gel for use by doctors and nurses consists of a main housing which mounts a pumping mechanism for pumping out an alcohol-glycerine disinfecting gel from a replaceable, disposable supply-cartridge releasably mounted in the main housing. The main housing consists of two, relatively-movable upper and lower sections. The two sections may be moved relative to each other by the gripping of just one hand. Since the main housing is small enough to fit within a person's hand, the doctor or nurse may dispense the contents of an alcohol-glycerine disinfecting gel simply by squeezing the two parts together. This squeezing operates the pumping mechanism in the housing, to cause some of the alcohol-glycerine disinfecting gel to exit through an outlet formed in the main housing, while also loading alcohol-glycerine disinfecting gel into the pumping mechanism for the next dispensing thereof. The dispensing of the gel is applied directly onto the fingers of the same hand that has squeezed the main housing to have caused such dispensing to occur. Owing to the small size of the main housing, the dispenser of the invention may be worn on-the-person, such as the pants-belt. Toward this end, the main housing is provided with a loop or strap through which the belt may pass. Thus, a doctor or nurse may dispense an alcohol-glycerine disinfecting gel directly onto one hand at any time and at any location, in order to help prevent the spread of infection.

BRIEF DESCRIPTION OF THE DRAWING

The invention will be more readily understood with reference to the accompanying drawing, wherein.

DETAILED DESCRIPTION OF THE INVENTION

Figure 6:
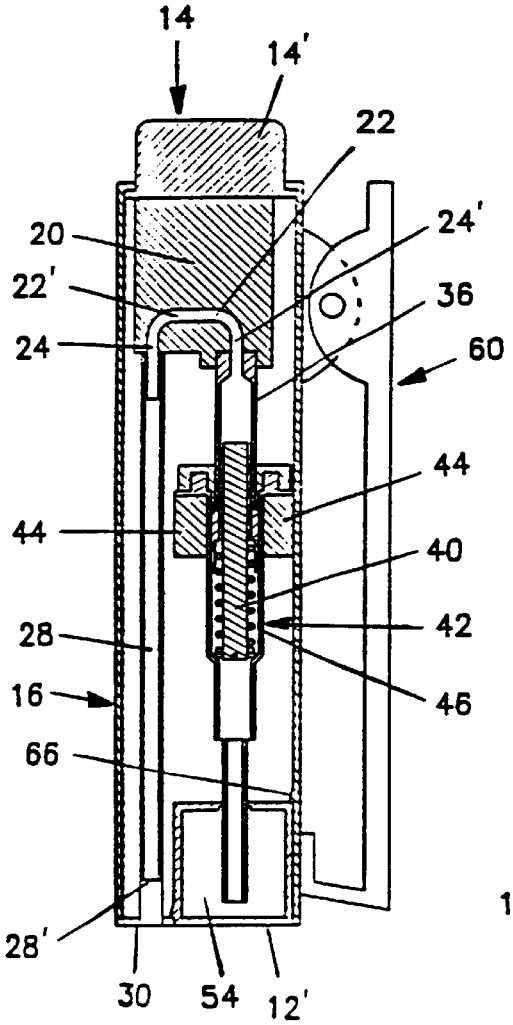
FIG. 6 is a cross-sectional view taken along line 6—6 of FIG. 3, which shows the state of the miniature dispenser for dispensing an alcohol-glycerine disinfecting gel of the invention is in its unsqueezed state.
Figure 7:
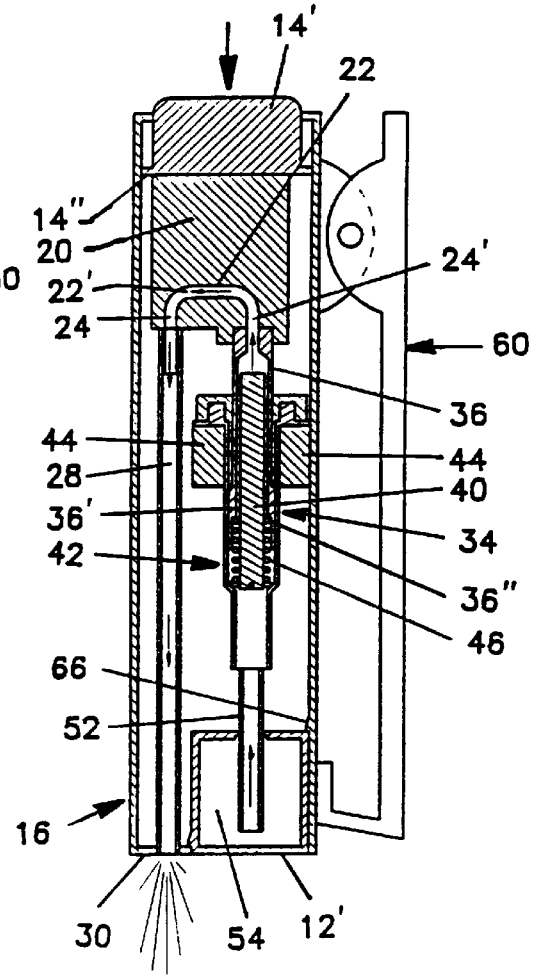
FIG. 7 is a cross-sectional view similar to FIG. 6 but showing the state of the miniature dispenser for dispensing an alcohol-glycerine disinfecting gel of the invention in its squeezed, dispensing state.

Referring now to the drawings in greater detail, where like reference numerals indicate like parts, the miniature dispenser for dispensing an alcohol-glycerine disinfecting gel is indicated generally by reference numeral 10. The miniature dispenser for dispensing an alcohol-glycerine disinfecting gel includes a main housing 12 made of a thermoplastic resin material consisting of two relatively-slidable sections: An upper section 14, and a lower section 16. The upper section 14 is slidable within the lower section 16, and has a main, upper protruding portion 14' against which a hand may push in order to slide the upper section downwardly into the lower section for actuating the pumping mechanism of the invention, as more fully described hereinbelow. The upper protruding portion 14' has a lower bead or flange 14" which prevents the upper protruding portion 14' from escaping the lower section 16, which flange 14" abuts against annular surface 16' of the upper surface of the lower section 16 when the upper protruding portion 14' is in its uppermost position, when the spring of the pumping mechanism returns the upper protruding portion to its free state, as described hereinbelow. Fixedly secured to the upper protruding portion 14' is a downwardly-extending mounting block 20 which mounts therein a portion of the dispensing mechanism. Within the mounting block 20 (see FIG. 7), there is provided a U-shaped internal passageway 22 which has a horizontal leg 22' and two vertical legs 24, 24' which are in fluid communication with the ends of the horizontal leg 22'. The internal vertical leg 24 is coupled to an external dispensing tube 28, which tube 28 extends the majority of the height of the main housing 12. The dispensing tube 28 defines a lower end 28' (see FIG. 6) which slides in upstanding, vertical tubular member 29, which terminates in opening or orifice 30 formed in the bottom wall 12' of the main housing's lower section, through which opening 30 the small quantity of alcohol-glycerine disinfecting gel exits onto to the fingers of the very same hand that squeezed the dispenser, in the manner seen in FIG. 5. The other internal horizontal leg 24' exits from the mounting block 20 and turns into an internal passage-way of a cylinder 36 of a pumping mechanism 34.

The lower section 16 of the main housing mounts the second half of the pumping mechanism 34, which includes pumping piston 40 which slides within the pumping cylinder 36. The pumping piston 40 is mounted in a mounting frame 42 fixedly secured to the internal surface of the lower section 16 via ears 44. Mounting frame 42 defines a lower, converging section 42' in which is seated the lower end of a compression spring 46. The lower end of the pumping piston 40 is also fixedly secured to the mounting frame 42 at this converging section 42' by a locking pin 40', or the like. The lower end of pumping cylinder 36 has an enlarged portion 36' which defines an interior step 36" against which the upper end of the spring 46 abuts for causing the upper section of the main frame to move away from the lower section in the free state, when no force is applied by a hand to dispense the gel. The mounting frame 42 terminates in a lower tubular section 50, the lower end of which is connected to a supply tube 52. The supply tube 52 extends downwardly into a supply cartridge or container 54 in which is stored the alcohol-glycerine disinfecting gel being dispensed. The alcohol-glycerine disinfecting gel is forced up through the supply tube 52, then through the tubular section 52, through the interior of the mounting plate 42 by flowing around and through the spring 46, and then to the interior of the pumping cylinder 36 by passing in between the outer circumference of the pumping piston 40 and the interior surface of the pumping cylinder. Thereafter, the alcohol-glycerine disinfecting gel is forced out through the internal U-shaped passageway 22, and then is dispensed through opening 30 after having passed through tube 28. Each droplet of alcohol-glycerine disinfecting gel travels this same path; however, it takes two pumping actions of the pumping mechanism to accomplish this. That is, when the upper and lower sections 14, 16 are squeezed together, the alcohol-glycerine disinfecting gel contained in the interior of the cylinder 36 is forced out. When the upper and lower sections are allowed to return to their normal state by means of the spring, such action will draw or suck up new alcohol-glycerine disinfecting gel into the interior of the cylinder which will be dispensed the next time the upper and lower sections are squeezed together. This pumping method for accomplishing the dispensing by first priming or loading the cylinder every time there is a dispensing, is well-known and conventional.

Figure 1:
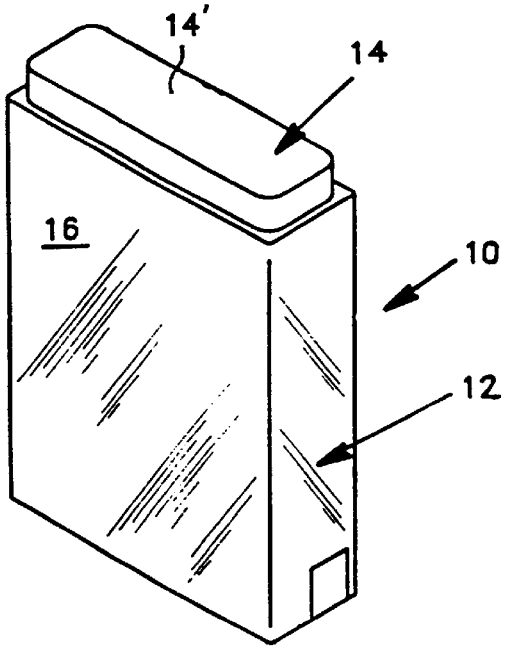
FIG. 1 is an isometric view of the miniature dispenser for dispensing an alcohol-glycerine disinfecting gel.
Figure 3:
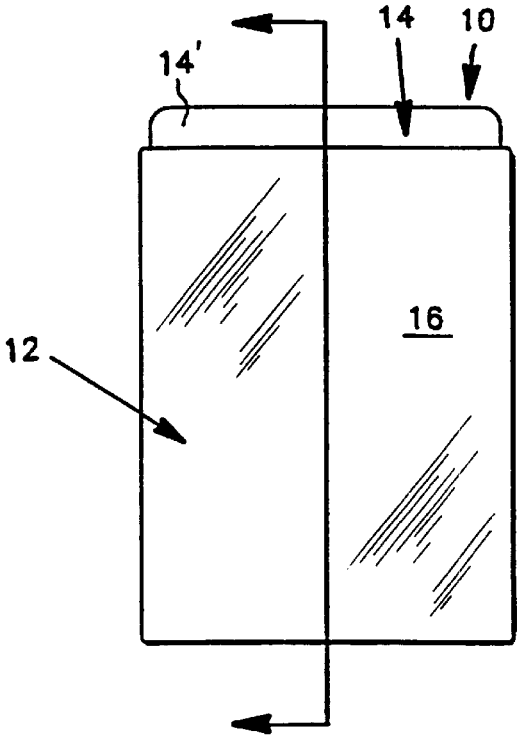
FIG. 3 is a front view thereof.
Figure 2:
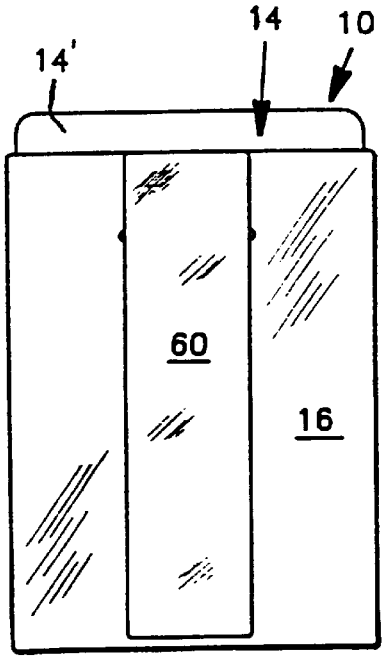
FIG. 2 is a rear view thereof.
Figure 4:
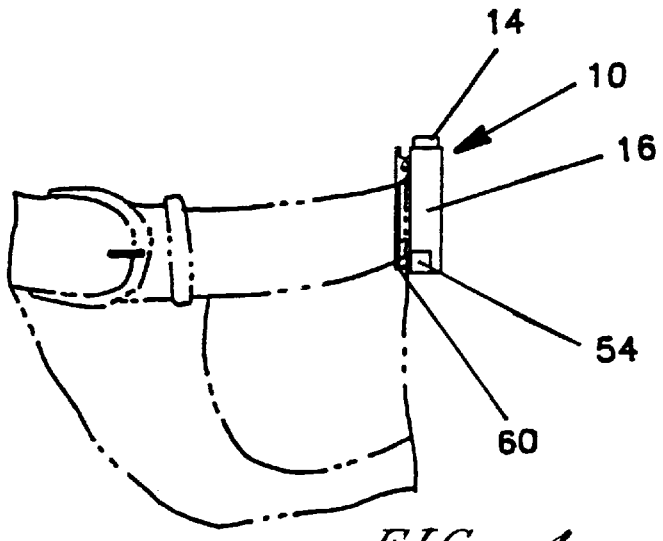
FIG. 4 is a plan view showing the miniature dispenser for dispensing an alcohol-glycerine disinfecting gel of FIG. 1 worn on-the-person by means of the waist-belt.
Figure 5:
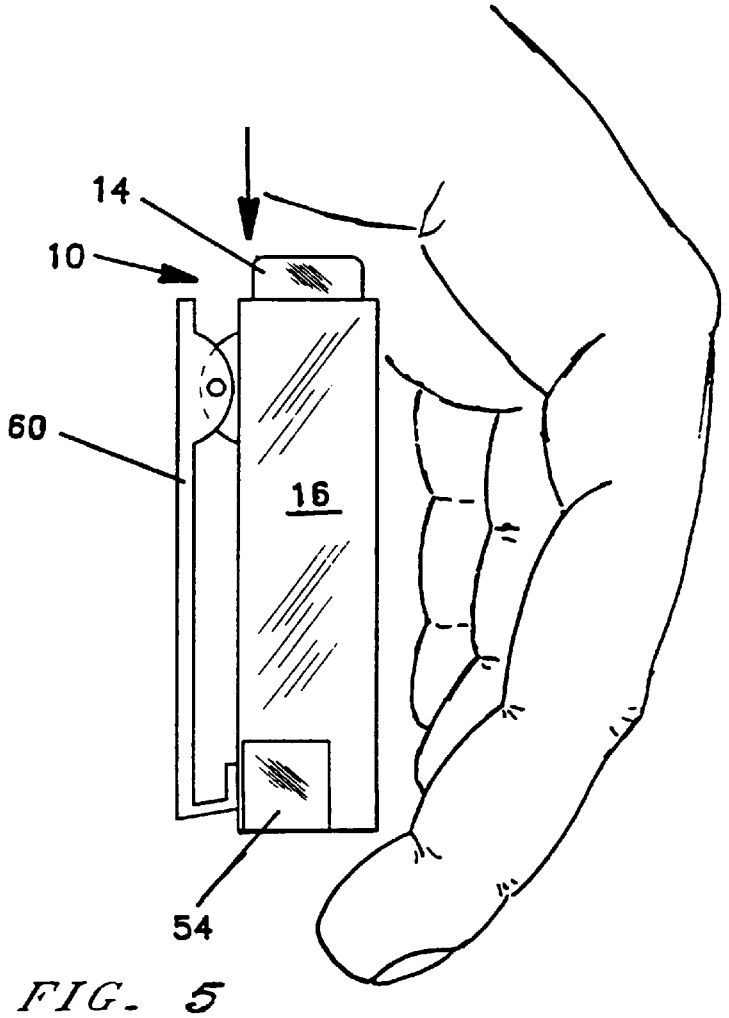
FIG. 5 is a side view showing how the miniature dispenser for dispensing an alcohol-glycerine disinfecting gel of FIG. 1 may be squeezed for dispensing by using just one hand, with the dispensed contents exiting onto the fingers of the hand that squeezed the dispenser for causing the dispensing.

As can be seen in FIG. 5, the dispenser 10 is of small enough size so as to fit inside a hand, so that just one hand may perform the squeezing together of the upper and lower sections 14, 16. The main housing 12 is also provided with a mounting loop 60 that is used for passing a waist-belt therethrough, so that the dispenser may be carried on-the-person, as seen in FIG. 4. The mounting loop or strap is connected to the rear face of the lower section 16 of the main housing.

Figure 8:
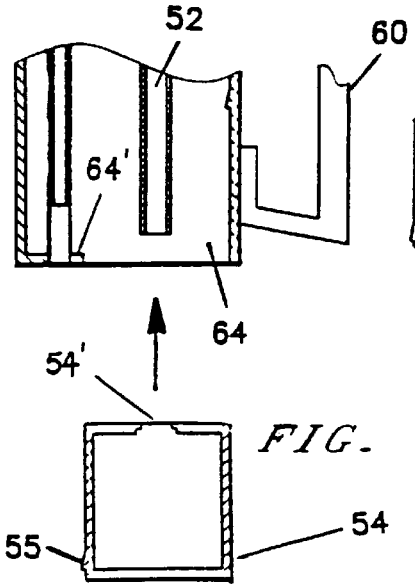
FIG. 8 is a plan view showing the replaceable, disposable supply-cartridge of alcohol-glycerine disinfecting gel, and how it is mounted in the main housing of the miniature dispenser.
Figure 9:
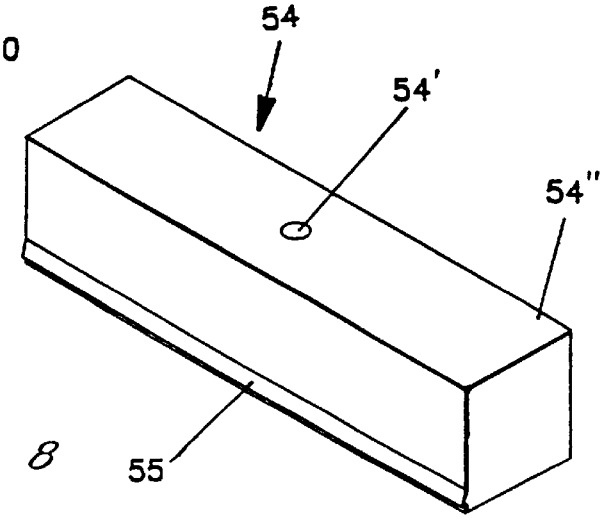
FIG. 9 is an isometric view of the replaceable, disposable supply-cartridge of alcohol-glycerine disinfecting gel.

The supply cartridge 54 is disposable and replaceable, so that when the supply of the cartridge runs out, it may be removed and replaced with a new, full cartridge. As seen in FIG. 9, the supply cartridge 54 has a through-hole 54' through which passes the lower end of the tube 52, as described above, and an elongated bead 55. The bottom of the lower section 16 of the main housing has a cut-way, or open, bottom-corner section 64 (see FIG. 8), which allows for the insertion of the supply cartridge into the interior of the main housing. The interior rear surface of the main housing has a bead 66 (see FIG. 6) against which the upper corner 54" of the supply cartridge abuts during loading of the supply cartridge. The bead 66 extends preferably the entire length of the rear wall of the main housing, in the manner that the bead 55 of the supply cartridge extends the full length of the supply cartridge, since, preferably, the lengths of the housing and the supply cartridge are the same. The diagonally-opposite lower corner of the supply cartridge is provided with a beaded portion 55 which cooperates with the free, exposed edge 64' of the open bottom section of the main housing. The beaded section 55 defines a downwardly canted surface, whereby when the supply cartridge is pushed up into the main housing during insertion, the beaded portion 55 is cammed inwardly to allow clearance past the edge 64', whereupon after clearance, the beaded portion resumes its original shape, in order to provide a snap-fit connection, in the well-known manner. During insertion of the new cartridge 54, the bottom end of the tube 52 is pushed through the opening 54' in the top surface of the supply, whereby the alcohol-glycerine disinfecting gel is ready to be dispensed. When removing the empty cartridge, owing to the resilient and flexible thermoplastic resin material from which the dispenser 10 is made, one merely pulls the front surface of the lower section 16 of the main housing away from the rear surface thereof, as by via the dispensing opening 30, whereby the bead 55 is allowed to clear past the edge 64'.

It is noted that while it has been shown that the discharge opening 30 is at the bottom of the main housing 12, it is within the scope and purview of the invention to dispense from the top of the housing or from the side thereof. Also, besides a gel being dispensed, a liquid may also be dispensed.

Figure 11:
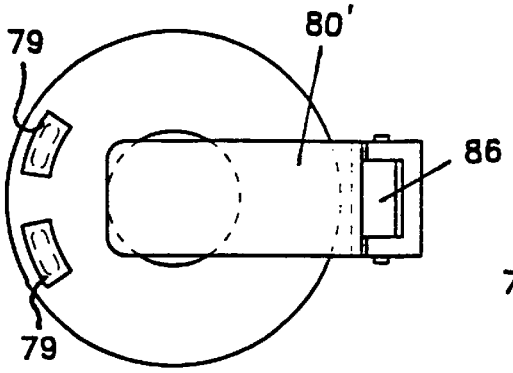
FIG. 11 is a top view thereof showing the dispensing holes sealed before use.
Figure 10:
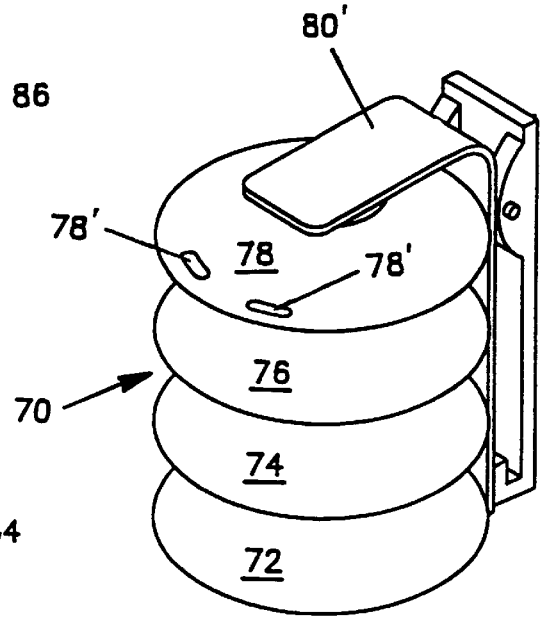
FIG. 10 is an isometric view of a second embodiment of the invention.
Figure 12:
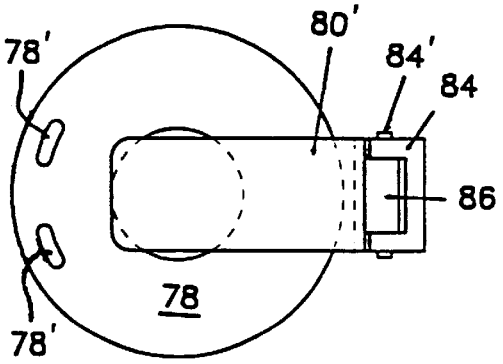
FIG. 12 is a top view thereof after the dispensing holes have been unsealed for use.
Figure 14:
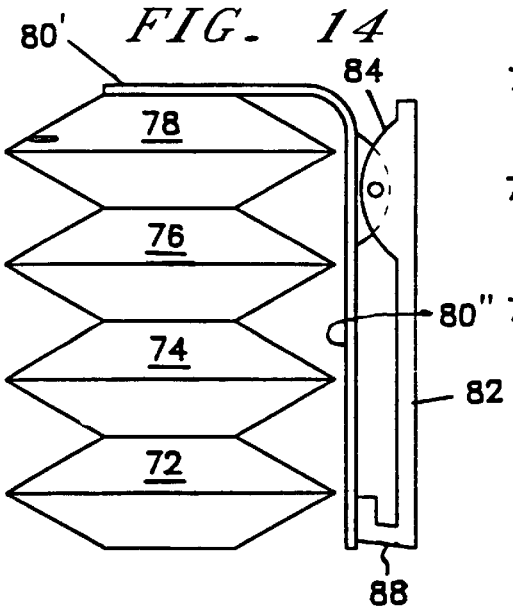
FIG. 14 is a second side-elevational view showing the dispenser in its dispensing position.
Figure 13:
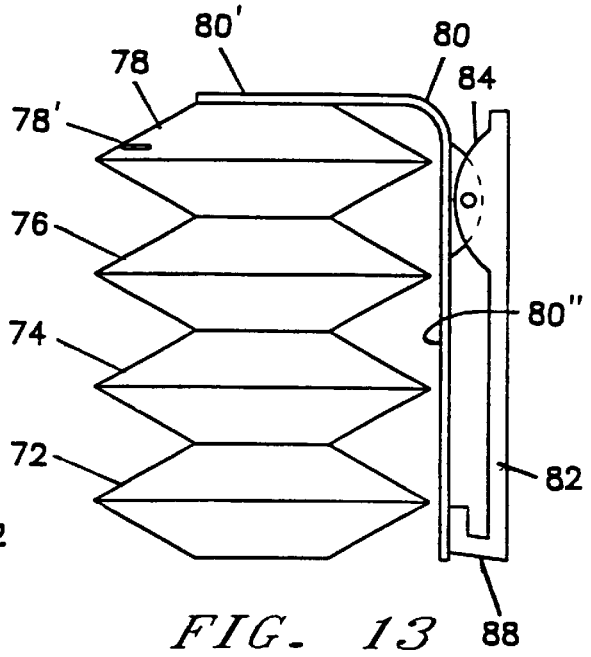
FIG. 13 is a side-elevational view thereof showing the dispenser in its non-dispensing position.
Figure 16:
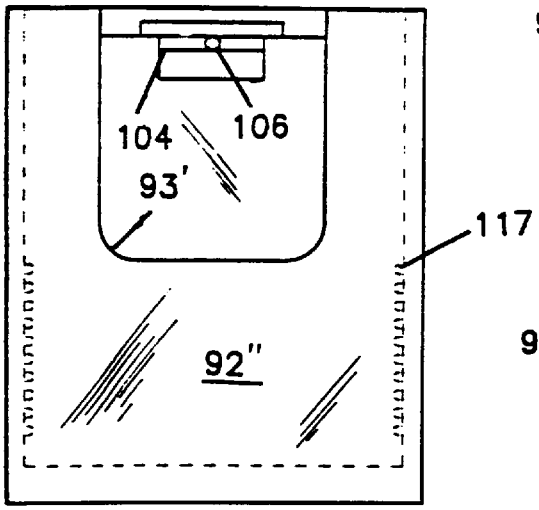
FIG. 16 is a front view thereof.
Figure 15:
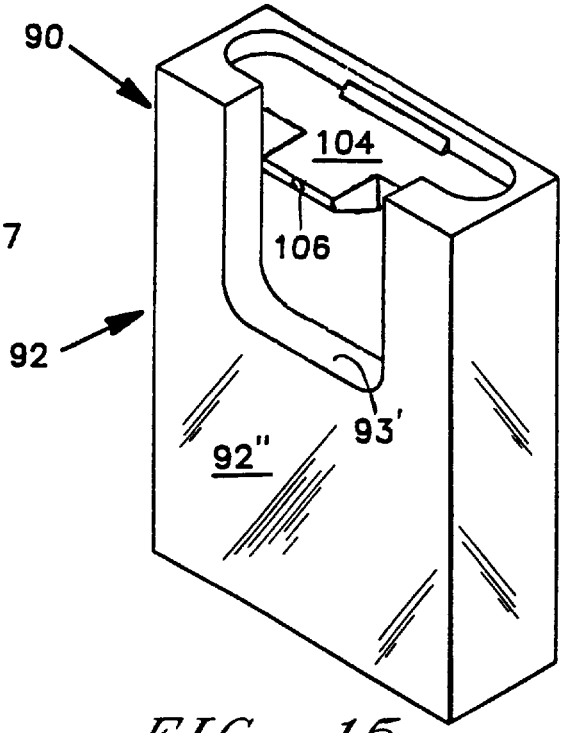
FIG. 15 is an isometric view of a third embodiment of the invention.
Figure 17:
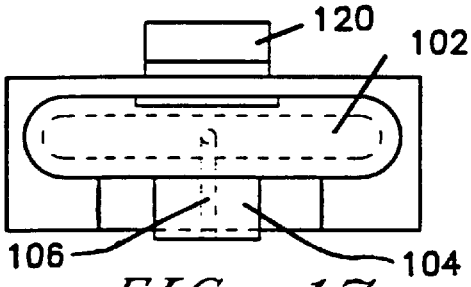
FIG. 17 is a top view thereof.

Referring now to FIGS.10–14, there is shown a second embodiment of the dispenser of the invention, indicated generally by reference numeral 70. The dispenser 70 is an accordion-style dispenser made of thermoplastic resin material that is preferably blow-molded, and is preferably designed as for one-time use, and thrown away thereafter. The dispenser 70 defines a hollow interior in which is stored the alcohol-gel, disinfecting solution. The dispenser is made up of a plurality of sections 72–78, with the upper section 78 having a pair of arcuately spaced-apart, elongated dispensing holes 78' formed therein, and through which the alcohol-gel, disinfecting solution is forced out as the sections 72–78 are squeezed together by one hand, in the same manner as described above in regards to the first embodiment of FIGS. 1–9; that is, the accordion-style dispenser 70 is also of such a small size so as to permit the squeezing there of by just one hand. As can be seen in FIG. 11, the dispensing holes 78' are sealed via thin, plastic seals 79 before the first use thereof. Fixedly attached to the upper section 78 is a horizontal leg-section 80' of a mounting bracket 80. The mounting bracket 80 has a vertical leg-section 80" to which is mounted a pivotal mounting clip 82 which is used for mounting or clipping the dispenser to a person, such as to a belt , shirt pocket, and the like. The mounting clip 82 is pivotally mounted at its upper end to an upper portion of the mounting bracket 80 via a pivot pin 84' extending between clevis 84 in the upper portion of the mounting clip, as best seen in FIG. 12. The pivot pin 84' also passes through a pivot housing 86 extending from the upper portion of the mounting bracket 80, whereby the clip 82 is allowed free rotational movement. The lower end 84' of the clip 82 is provided with a bent-angle piece 88 that faces inwardly toward the lower end of the mounting bracket's vertical leg-section 80", in order to keep the clip 82 substantially parallel to the vertical leg-section 80". Mounted within the pivot housing 86 is a torsion spring (not shown), or the like, for biassing the mounting clip in a clockwise direction when viewing FIG. 13, whereby the dispenser is held onto a belt or pocket or the like in a sure manner. Each accordion-section 72–78 defines a lower and an upper frustoconical section, with adjoining sections being connected together at the top or bottom truncated surface area, whereby the accordion-style dispenser is formed, that allows the movement of the sections 72–78 toward and away from each other, for dispensing its contents. In one version of the dispenser 70, each frustoconical section is made of rubber or rubber-like material, and has sloping side surfaces of about 45-degrees.

Figure 18:
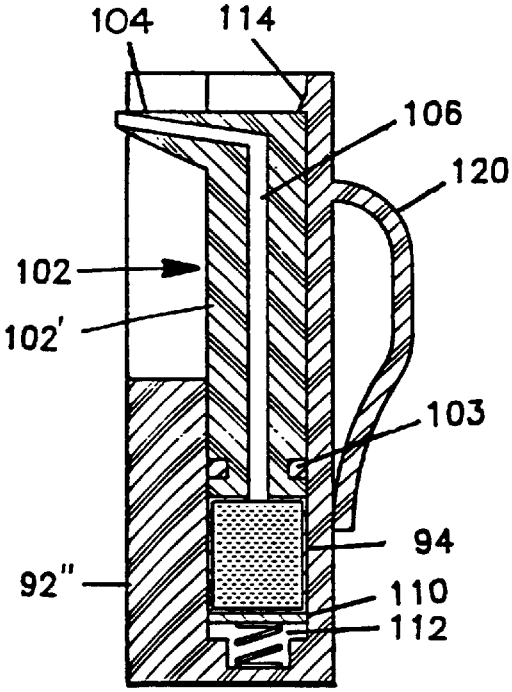
FIG. 18 is a side-elevational view thereof showing the dispenser in its non-dispensing position.
Figure 19:
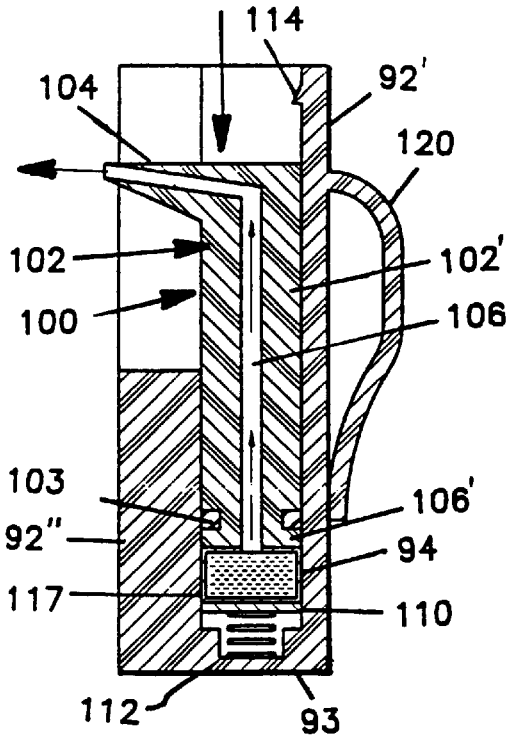
FIG. 19 is a side-elevational view thereof showing the dispenser in its dispensing position.

Referring now to FIGS. 15–19, there is shown a third embodiment of the dispenser of the invention, indicated generally by reference numeral 90. The dispenser 90 has an outer solid housing 92 in the hollow interior of which is received a replaceable cartridge 94 filled with the alcohol-gel, disinfecting solution to be dispensed having an access-hole similar to hole 54' of FIG. 9 of the first embodiment. The main housing 92 has a rear wall 92' extending the full height of the dispenser, a front wall 92" having a central section extending only partially the height of the dispenser in order to define a cutout-section 93" which front wall is spaced from the rear wall by side walls, and a bottom wall 93 from which extend upwardly the front and rear walls. The volume between the front and rear walls defines a cavity in which the stored the replaceable cartridge 94, as well as the plunger-mechanism 100 for pumping out the solution for dispensing. The plunger-mechanism 100 is made up of plunger 102 having a main vertical section 102' and an angularly-extending spout-section 104 which projects through, and is accessible by, the cutout-section 93' of the front wall 92", as best seen in FIGS. 18 and 19. The vertical section 102' is sealed via o-ring 103 within the cavity between the front and rear walls. The plunger 102 is formed with an internal passageway 106 which has a bottom vertically-downwardly protruding tube 106' having a bottom pointed end that pierces through a sealed upper opening formed in the cartridge 94, through which internal passageway 106 the solution is forced during dispensing. The bottom pointed end f the tube 106' extends to the bottom of the cartridge to ensure that all of the solution may be dispensed. The tube 1–6' is similar to the tube 52 of FIG. 7 of the first embodiment. Positioned in the bottom of the mounting cavity is a spring-biassed plate 110 that is biassed upwardly by compression spring 112, which plate abuts against the bottom of the cartridge 94 to thereby urge the cartridge and the plunger 102 upwardly until the upper surface of the plunger 102 abuts against an inwardly-protruding tab or stop 114 formed in the interior upper section of the rear wall 92'. The tab or stop 114 prevents the plunger from falling out of the cavity in response to the biassing force of the spring-plate combination 110, 112. When dispensing the solution from the cartridge 94, one simply squeezes the dispenser with one hand, as described above with regard to the first and second embodiments, which initially forces air out of the internal passageway 106 (FIG. 19). When the plunger is released, the plunger is forced upwardly by the spring 112, creating a partial vacuum in the passageway 106, to thereby suck up solution in the cartridge 94 which will be dispensed out through the spout-section 104 the next time the plunger is depressed (FIG. 18). The first time the dispenser is used, it will have to be primed, as is well-known. The rear wall 92' is also provided with a mounting clip 120 for mounting the dispenser to a person via a belt, shirt pocket, and the like.

While the dispenser 90 is shown with a plate 110 and spring 112 for biassing the plate upwardly against the cartridge 94, it is within the scope and purview of the invention to do with away with the spring and biassed plate, and allow for the dispensing of the solution therewithout. In this case, after initial priming of the pump, the bottom wall 93 of the plunger 102 will be spaced above the cartridge 94, and will simply remain in its previously-dispensed position until it is used for dispensing again, after which subsequent dispensing, is will be in a lower position. Thus, during use, the plunger 102 will gradually descend after every use lower into the cavity. In this case, the pointed bottom end of the tube 106' associated with the internal passageway 106 will, before the first use thereof, initially extend into the interior of the cartridge 94 a minimal amount, adjacent the very top thereof, and after each dispensing, the lower end of the tube 106' will descend lower into the interior of the cartridge, until it reaches bottom and no more solution is present to be dispensed. The cartridge 94 may comprise a supply bag made of soft, contractible plastic, so that the end of the tube 106' need only extend into the very top of the interior of the bag; and whereby as the plunger 102 is lowered, the bag itself is compressed to force up the solution.

Figure 23:
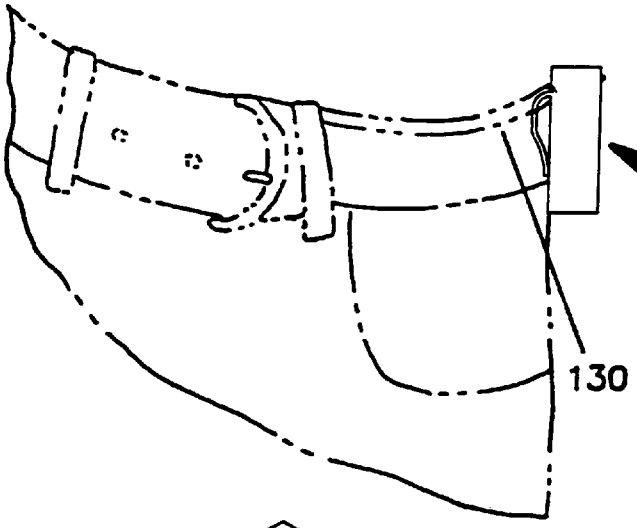
FIG. 23 is an isometric view showing the dispenser of the invention being worn on the person via a dedicated, integral mounting belt therefor.
Figure 20:
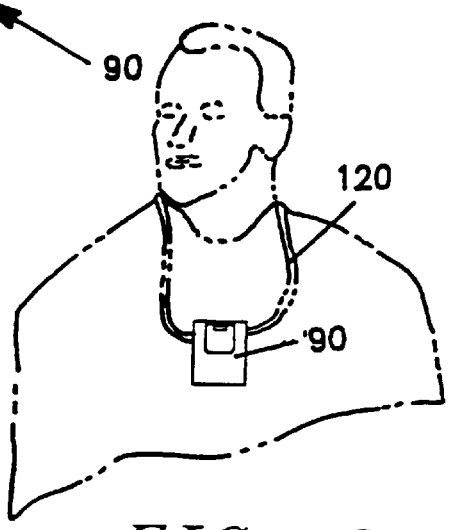
FIG. 20 is an isometric view showing the dispenser of the invention being clipped, or worn, by a doctor, or the like, suspended from his neck via a neck-chain.
Figure 21:
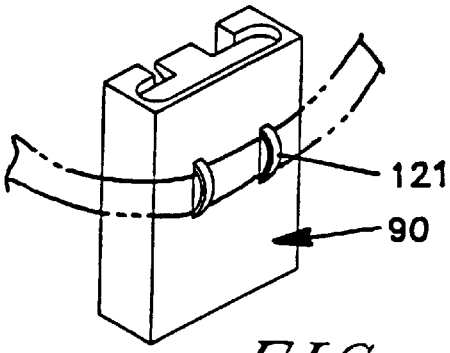
FIG. 21 is an isometric view showing the dispenser of the invention having rear loops for receiving the neck-chain of FIG. 20.
Figure 22:
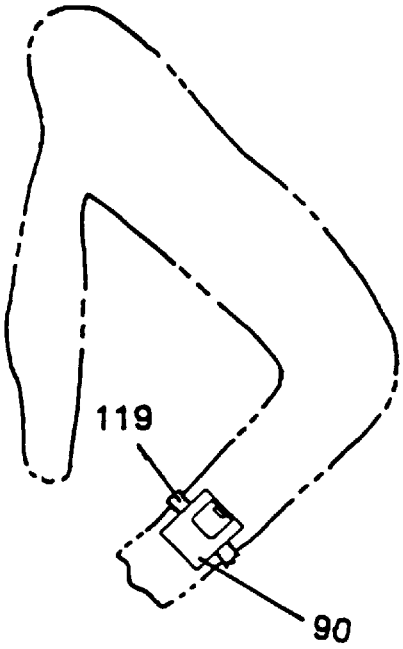
FIG. 22 is an isometric view showing the dispenser of the invention being worn around the wrist of a person via a wrist-band.
Figure 24:
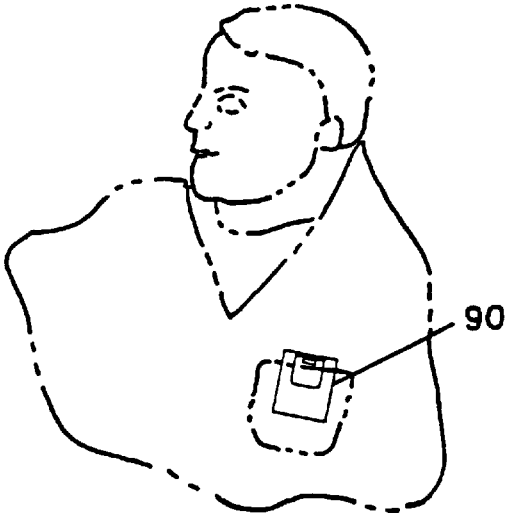
FIG. 24 is an isometric view showing the dispenser of the invention being clipped, or worn, by a doctor, or the like, to his shirt pocket.

Referring to FIGS. 20–24, there are shown various ways of mounting the dispenser of the invention on-the-person. In FIGS. 20 and 21, instead of mounting the dispenser via belt, as shown in FIG. 4 of the first embodiment, the dispenser 10, 70 or 90 is suspended about the neck using a neck-chain 120 that is connected to the dispenser via loops 121, on the rear of the dispenser. FIG. 22 shows mounting the dispenser 10, 70 or 90 to a person by means of a wrist-band 119 for placement around the wrist, using the same loops 121. FIG. 23 shows forming the dispenser 10 or 90 with its own dedicated, integral belt 130, whereby the belt is permanently attached to the dispenser 10 or 90. FIG. 24 shows the clipping the dispenser 10, 70 or 90 to a shirt pocket via the rear clip of the dispenser.

It is, also, possible that to provide a series of small protuberances, such as 117 in FIG. 19, within the lower interior wall surface of the portion of the main housing in which the plunger slides, and against which the O-ring seal 106' abuts every time the plunger mechanism is pushed down. The series of protuberances are vertically spaced apart from each other a distance that, when the the plunger is moved downwardly that distance, a small amount of disinfecting gel is dispensed. This gives an indication to the user of the device how much to push down on the plunger mechanism each time in order to dispense the requisite small amount. These protuberances 117 would be especially useful when no spring 112 is provided.

It is, also possible to provide any of the versions of the invention is a size that is too large to fit in one hand. In this case, the front surface, such as 92" of FIG. 15, would be provided with a recess or detent or hook for use by the index or middle finger of a hand, whereby the dispenser may still be dispensed using just one hand, where the thumb of the one hand pushed down on the top of the dispenser, while the index or middle finger grips the recess or detent.

While it has been disclosed that an alcohol/glycerine liquid or gel may be dispensed by the dispenser of the invention, other disinfecting solutions or germicides may be used, such liquid hand soaps with triclosan or triclorocarbon, although a solution of alcohol and glycerine is preferred. In addition, other emollients may be used besides glycerine.

While specific embodiments of the invention have been shown and described, it is to be understood that numerous changes and modifications may be made therein without departing from the scope, spirit and intent of the invention as set forth in the appended claims.

What I claim is:

1. In a dispenser for dispensing small amounts of a solution comprising a main housing and a discharge outlet, a supply of a solution in said main housing to be dispensed, means for pumping out the solution from through said discharge outlet, wherein the improvement comprises:

said main housing being operable by one hand for pumping out said solution;

securing means operatively associated with said main housing for securing said main housing to a person, whereby the dispenser may be worn on-the-person for transport with the person;

said supply comprising disinfecting liquid or gel for disinfecting the hands;

said discharge outlet having a discharge opening that dispenses said disinfecting liquid or gel such that the dispensed disinfecting liquid or gel is not directed toward the person when said securing means mounts said main housing to a person for dispensing the disinfecting liquid or gel;

said discharge outlet dispensing said disinfecting liquid or gel for disinfecting the hands directly onto said one hand that operates said means for pumping out said solution while said securing means mounts said main housing to the person.

2. The dispenser for dispensing small amounts of a solution according to claim 1, wherein said supply comprises a removable supply cartridge; said main housing comprising a hollow interior for mounting said removable supply cartridge therein; said means for pumping comprising a plunger means mounted in said hollow interior above said removable supply cartridge and having an internal passageway through which the disinfecting solution travels from said removable supply cartridge to said discharge outlet; tube means having a first end in fluid communication with said internal passageway and a second end inserted in said removable supply cartridge; said plunger means being slidably mounted in said hollow interior for at least slidable movement toward said removable supply cartridge.

3. The dispenser for dispensing small amounts of a solution according to claim 2, wherein said plunger means is mounted in said hollow interior for abutting contact against said removable supply cartridge; and further comprising biassing means for biassing said removable supply cartridge, and, therefore, said plunger means, upwardly; said housing having stop means for preventing said plunger means from escaping said hollow interior when said biassing means moves said plunger means upwardly within said housing.

4. The dispenser for dispensing small amounts of a solution according to claim 2, wherein said main housing comprises a front wall and a rear wall, said front wall comprising an upper cutout section; said plunger means comprising an upper spout-section; said upper spout-section extending forwardly through said cutout-section of said front wall; said discharge outlet being formed in said upper spout-section extending forwardly through said cutout-section of said front wall.

5. The dispenser for dispensing small amounts of a solution according to claim 1, wherein said supply comprises a removable supply cartridge.

6. The dispenser for dispensing small amounts of a solution according to claim 5, wherein said removable supply cartridge comprises a contracting, supply bag of disinfecting solution.

7. The dispenser for dispensing small amounts of a solution according to claim 1, wherein said main housing comprising a hollow interior for storing said supply of disinfecting solution; said housing being accordion-like for allowing compression thereof in order to squeeze out said disinfecting solution; said means for pumping comprising a plurality of compressible accordion-sections constituting said main housing whereby when said compressible accordion-sections are squeezed by a hand and compressed, said disinfecting solution is forced out through said discharge outlet.

8. The dispenser for dispensing small amounts of a solution according to claim 7, wherein said discharge outlet is formed in the top-most section of said plurality of compressible accordion-sections.

9. The dispenser for dispensing small amounts of a solution according to claim 8, wherein said securing means comprises a first section secured to the upper surface of said top-most section, and a second section extending at an angle thereto in a direction along said plurality of compressible accordion-sections, and clip means mounted to said second section for clipping said main housing to a garment of a person.

10. The dispenser for dispensing small amounts of a solution according to claim 7, wherein each of said plurality of compressible accordion-sections a lower and an upper frustoconical section, said lower frustoconical section having a truncated lower surface, and said upper frustoconical surface having a truncated upper surface, adjoining sections of said plurality of compressible accordion-sections being connected together at the respective said upper and lower truncated surfaces thereof.

11. A method of dispensing a small amount of disinfecting solution by means of a small dispenser having a discharge outlet and a supply of said solution, comprising:

(a) removably attaching the small dispenser to a person;

(b) dispensing a small quantity of said solution into a hand of the person to whom said dispenser has been attached while said small dispenser is still attached to the person;

(c) said step (b) comprising dispensing a small qunatity using one hand, and squeezing said dispenser with said one hand to cause a small amount of said solution to exit through said discharge outlet onto said one hand, said solution exiting through said discharge during said step of dispensing.

12. The method of dispensing a small amount of disinfecting solution according to claim 11, wherein said step (c) comprises squeezing a compressible, accordion-shaped main housing in which is stored the disinfecting solution, to forcibly squeeze the solution out through the discharge outlet.

13. The method of dispensing a small amount of alcohol-disinfecting solution according to claim 11, wherein said step (a) comprises securing the dispenser to the waist-belt of the person.

14. In a dispenser for dispensing small amounts of a solution comprising a main housing and a discharge outlet, and a supply of solution to be dispensed through said discharge outlet, wherein improvement comprises:

said main housing being of an overall size so as to be useable by one hand;

securing means operatively associated with said main housing for securing said main housing to a person, whereby the dispenser may be worn on-the-person for transport with the person;

said discharge outlet dispensing said solution directly onto said one hand that operates said pumping means for pumping out said solution while said securing means secures said main housing to a person.

15. The dispenser for dispensing small amounts of a solution according to claim 14, wherein said main housing comprises a plurality of compressible accordion-sections whereby when said compressible accordion-sections are squeezed by a hand and compressed, said disinfecting solution is forced out through said discharge outlet.

16. The dispenser for dispensing small amounts of a solution according to claim 15, wherein said discharge outlet is formed in the top-most section of said plurality of compressible accordion-sections.

17. The dispenser for dispensing small amounts of a solution according to claim 16, wherein said securing means comprises a first section secured to the upper surface of said top-most section, and a second section extending at an angle thereto in a direction along said plurality of compressible accordion-sections, and clip means mounted to said second section for clipping said main housing to a garment of a person.

18. The dispenser for dispensing small amounts of a solution according to claim 15, wherein each of said plurality of compressible accordion-sections includes a lower and an upper frustoconical section, said lower frustoconical section having a truncated lower surface, and said upper frustoconical section having a truncated upper surface, adjoining sections of said plurality of compressible accordion-sections being connected together at the respective said upper and lower truncated surfaces thereof.

19. In a dispenser for dispensing small amounts of a solution comprising a main housing and a discharge outlet through which said solution is dispensed, and a supply of solution to be dispensed, wherein the improvement comprises:

said main housing being of a small overall size so as to be operable by one hand for dispensing said solution;

and securing means operatively associated with said main housing for securing said main housing to a person, whereby the dispenser may be worn on-the-person for transport with the person;

said supply of solution comprising a disinfecting liquid or gel for disinfecting the hands;

said discharge outlet having a discharge opening facing away from the person when said securing means mounts said main housing to a person for dispensing the disinfecting liquid or gel;

said discharge outlet dispensing said disinfecting liquid or gel for disinfecting the hands directly onto said one hand that operates said pumping means for pumping out said solution.

* * * * *